US006603381B2

(12) United States Patent
Attarian et al.

(10) Patent No.: US 6,603,381 B2
(45) Date of Patent: Aug. 5, 2003

(54) PRIMARY CONDUCTOR FOR A TRANSFORMER

(75) Inventors: Farshid Attarian, Collinsville, CT (US); Alberto Anibal Figueroa, Southington, CT (US); Joseph Criniti, New Britain, CT (US); Javier Ignacio Larranaga, Bristol, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,278

(22) Filed: Aug. 13, 2001

(65) Prior Publication Data

US 2003/0030528 A1 Feb. 13, 2003

(51) Int. Cl.[7] ..... H01F 17/06
(52) U.S. Cl. ..... 336/175; 335/18
(58) Field of Search ..... 336/173, 182, 336/229, 175; 335/18, 167–176

(56) References Cited

U.S. PATENT DOCUMENTS

| | | | | | |
|---|---|---|---|---|---|
| 3,649,912 | A | * | 3/1972 | Nakamura | 324/127 |
| 4,630,018 | A | * | 12/1986 | May et al. | 336/175 |
| 4,857,837 | A | | 8/1989 | Baran et al. | |
| 4,884,048 | A | * | 11/1989 | Castonguay et al. | 335/18 |
| 5,218,331 | A | * | 6/1993 | Morris et al. | 335/18 |
| 5,583,732 | A | * | 12/1996 | Seymour et al. | 361/93 |
| 5,886,606 | A | * | 3/1999 | Tosaka et al. | 335/172 |

* cited by examiner

*Primary Examiner*—Tuyen T. Nguyen
(74) *Attorney, Agent, or Firm*—Cantor Colburn LLP

(57) ABSTRACT

A transformer includes a core having an aperture formed therein and a conductive bar extending through the core. The aperture in the core has a centroidal axis The conductive bar includes: a first surface extending generally parallel to the centroidal axis, a second surface opposite the first surface and extending generally parallel to the centroidal axis, the first surface being closer than the second surface to said centroidal axis. The conductive bar also includes means for diverting electrical current flowing through the conductive bar towards said first surface.

12 Claims, 6 Drawing Sheets

PRIMARY CONDUCTOR FOR A TRANSFORMER

BACKGROUND OF INVENTION

A transformer typically includes two or more inductively coupled windings that effect the transfer of electric energy from one circuit to another with a change in voltage, current, phase, or other electric characteristic. Transformers are used in many different electrical devices. For example, transformers are used in modern circuit breaker devices for sensing current in an electrical distribution circuit and providing a signal indicative of the sensed current to electronic circuitry, known as a trip unit, housed in the circuit breaker.

In modern circuit breaker devices, the transformer typically includes two multi-turn, secondary windings. One secondary winding is disposed around a top of the core and the other secondary winding disposed around the bottom of the core. Each of the secondary windings is electrically connected to the circuit breaker's electronic trip unit. The transformer core is a toroidal, rectangular, or square shaped structure with an aperture disposed through its center. The primary winding is a primary conductor that extends through the aperture of the core. The primary conductor is electrically connected in series between a current carrying strap within the circuit breaker and a load conductor of the electrical distribution circuit. The primary conductor is a cast metal structure configured to support the core and the secondary windings.

In a circuit breaking device, the primary conductor is subjected to a very wide range of current within the operating range of the circuit breaking device. During quiescent operation, current through the primary conductor can be equal to a rated current of the circuit breaker, and during short circuit fault conditions the current through the primary conductor can exceed sixteen times (16×) the rated current of the circuit breaker. The transformer is designed to operate over this entire range. Design consideration for the transformer include: current measurement accuracy, temperature increase, are, and cost.

The current measurement accuracy of the transformer is dependent on the transformer's ability to maintain a substantially linear relationship between flux intensity and flux density in the core throughout most of the operating current range (e.g., from 1× to 16× the rated current of the circuit breaker). To this end, the transformer is designed such that the core does not become saturated with magnetic flux at any point throughout the operating current range. Once the core becomes saturated, the linear relationship between flux intensity and flux no longer exists.

The physical placement of the primary conductor within the aperture of the core affects the point at which the core becomes saturated. As a result, it is desirable to center the primary conductor along the centroidal axis of the aperture of the core. However, due to space limitations in the circuit breaker housing, it is not always possible to place the primary conductor in the center of the aperture.

Where the primary conductor cannot be placed in the center of the aperture, transformers of the prior art have been designed with an increase in the size of the core in the section closest to the primary conductor. The additional material prevents magnetic saturation of the core in this section. Problematically, however, the increase in the size of the core is often times constrained by physical space limitations. In addition, the material added to the core increases the cost of the core.

In addition to being accurate over the operating current range, the transformer should not exceed predetermined temperature limits at any operating current within this range. For example, transformers should not exceed the temperature limits set by Underwriter's Laboratories (UL) Section 489, which requires that the temperature of the transformer not exceed fifty degrees Celsius over ambient temperature.

SUMMARY OF INVENTION

The above discussed and other drawbacks and deficiencies of the prior art are overcome or alleviated by a transformer including: a core having an aperture formed therein, the aperture having a centroidal axis; and a conductive bar extending through the core. The conductive bar includes: a first surface extending generally parallel to the centroidal axis, a second surface opposite the first surface and extending generally parallel to the centroidal axis, the first surface being closer than the second surface to said centroidal axis, and means for diverting electrical current flowing through the conductive bar towards said first surface.

The above-discussed and other features and advantages of the present invention will be appreciated and understood by those skilled in the art from the following detailed description and drawings.

BRIEF DESCRIPTION OF DRAWINGS

Referring to the exemplary drawings wherein like elements are numbered alike in the several Figures.

DETAILED DESCRIPTION

Figure 1:
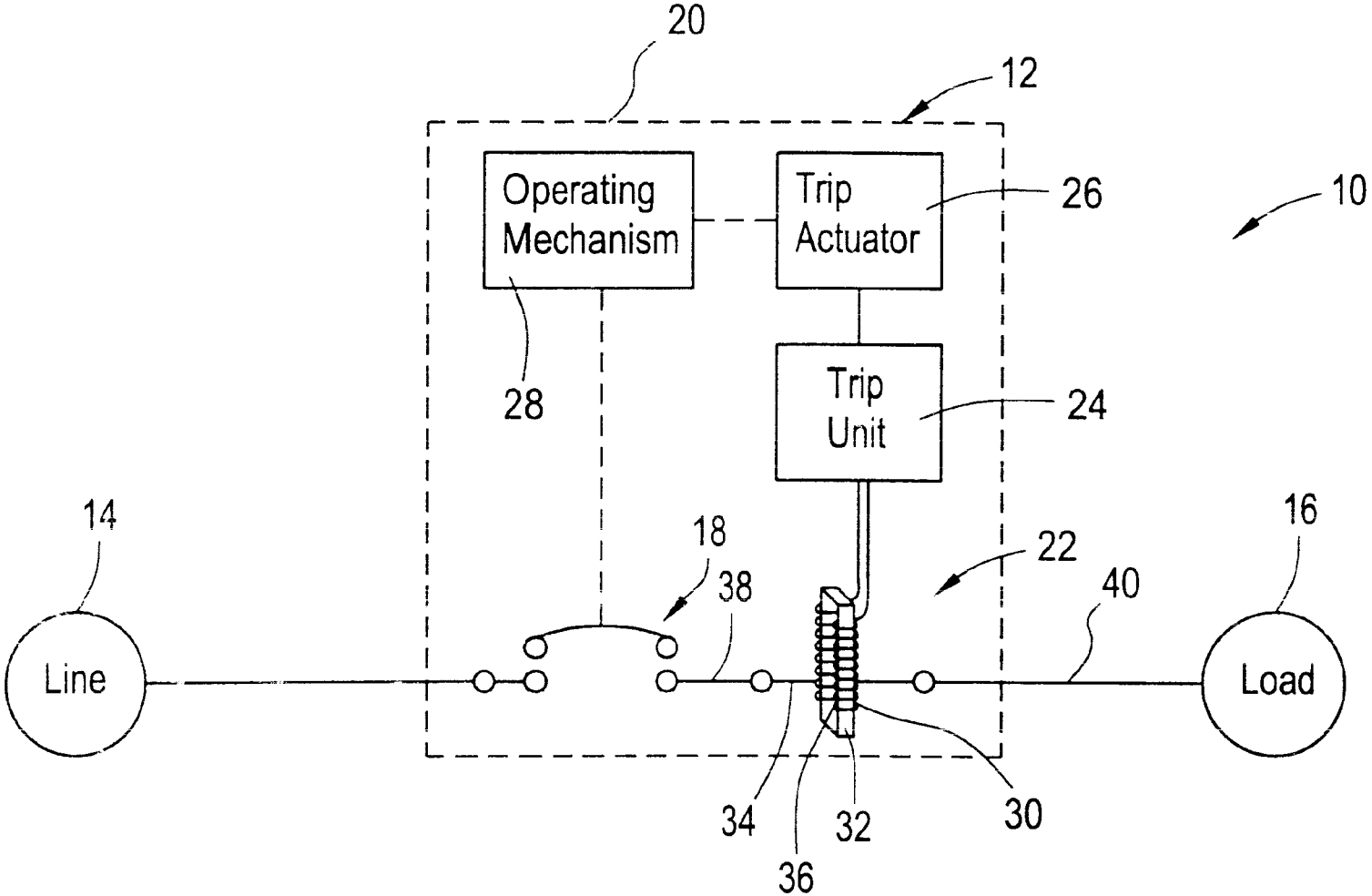
FIG. 1 is a schematic diagram of an electrical distribution system including a circuit breaker.

Referring to FIG. 1, a schematic diagram of an electrical distribution system 10 including a circuit breaker 12 is shown. Circuit breaker 12 is electrically connected between a line-side power supply 14 and an electrical load 16. Circuit breaker 12 includes electrical contacts 18 mounted within a housing 20 and connected in series between power supply 14 and load 16. Contacts 18 are separable to stop the flow of electrical current from power supply 14 to load 16. Also mounted within housing 20 are a transformer 22, an electronic trip unit 24, a trip actuator 26, and an operating mechanism 28.

Transformer 22 includes one or more multi-turn, secondary windings 30, a ferrous core 32, and a single-turn primary conductor 34. Each of the secondary windings 30 is electrically connected to electronic trip unit 24. The transformer core 32 is a toroidal, rectangular, or square shaped structure with an aperture 36 disposed through its center. The primary conductor 34 is a single-turn winding that extends through aperture 36. The primary conductor 34 is electrically connected to contacts 18 via a contact strap 38, and is electrically coupled to load 16 via a load-side conductor 40.

Trip unit 24 is an electronic circuit electrically coupled to secondary winding 30 and to the trip actuator 26. The trip actuator 26 is an electromechanical device, such as a solenoid or flux shift device, that is mechanically coupled to the operating mechanism 28. The operating mechanism 28 is a spring-driven, mechanical latching device that is mechanically coupled to the separable contacts 18. The construction of trip unit 24, trip actuator 26, and operating mechanism 28 are well-known in the art.

During operation, current passing through the primary conductor 34 induces magnetic flux in the core 32, which, in turn, induces a current signal in the secondary winding 30. The current signal, which is proportional to the current in the primary conductor 34, is provided to the trip unit 24. The trip unit 24 compares the current signal to a predetermined threshold to determine the existence of an anomalous condition in the electrical distribution circuit 10. Such anomalous conditions include, for example, an overcurrent condition, a phase loss condition, a ground fault condition, and the like. Upon detecting the anomalous condition, the trip unit 24 provides a trip signal to the trip actuator 26. Upon receiving the trip signal, the trip actuator 26 unlatches (trips) the operating mechanism 28. When tripped, one or more springs (not shown) in operating mechanism 28 act to effect the separation of the contacts 18 to stop the flow of electrical current from power supply 14 to load 16.

Figure 2:
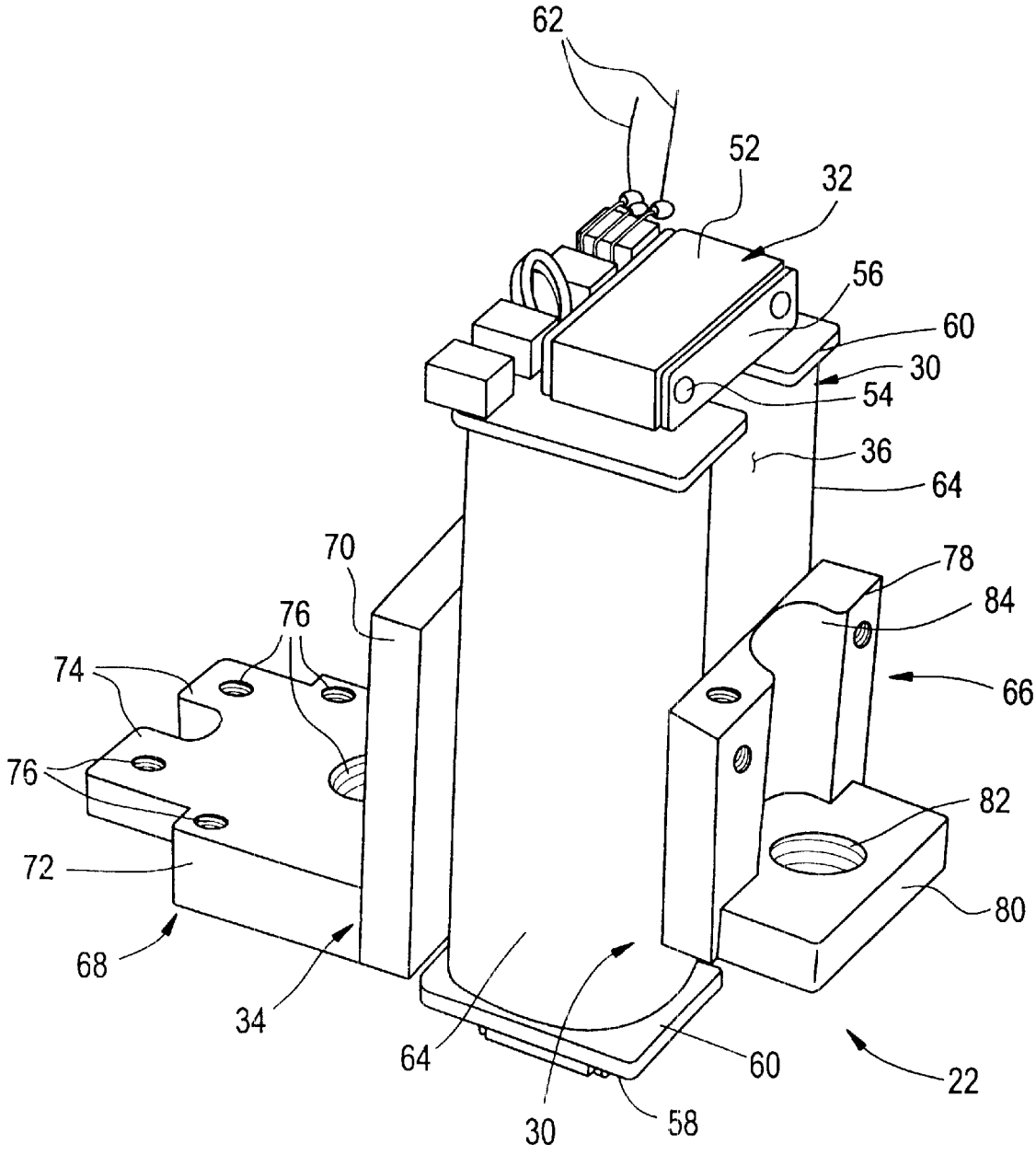
FIG. 2 is a perspective view of the transformer of FIG. 1.

FIG. 2 is a perspective view of transformer 22, which includes core 32, two secondary windings 30, and primary conductor 34. Core 32 includes a top leg 52, two side legs 54 and 56 depending from the top leg 52, and a bottom leg 58 extending between the two side legs 54 and 56.

One secondary winding 30 is disposed around each side leg 54 and 56 of core 32. Each secondary winding 30 includes an insulative bobbin 60 with a wire 62 wrapped around the bobbin 60 to form a multiple number of turns. Wrapped around the multiple turns of wire 62 is an insulative tape 64. Bobbin 60 provides electrical insulation between wire 62 and core 32, insulative tape 64 provides electrical insulation between wire 62 and primary conductor 34.

Primary conductor 34 includes a line-side lug 66, a load-side lug 68, and a conductive bar (not shown), which extends from line-side lug 66 to load-side lug 68. Load-side lug 68 includes a flange 70 and a connection lug 72. Flange 70 is a generally rectangular, flat plate that extends parallel to core 32. The conductive bar (not shown) extends from a surface of flange 70 proximate core 32. Connection lug 72 is a generally rectangular, flat plate that extends perpendicularly from a lower edge of flange 70, on a side of flange 70 distal to core 32. A pair of tabs 74 extend from a free end of connection lug 72 distal from flange 70, and a plurality of threaded holes 76 are disposed in connection lug 72. Tabs 74 and threaded holes 76 allow the connection of load-side lug 68 to the load-side conductor 40 (FIG. 1) using a bolt, rivet, screw, or other similar fastening device.

Line-side lug 66 includes a flange 78 and a connection lug 80. Flange 78 is a generally rectangular, flat plate that extends parallel to core 32. The conductive bar (not shown) extends from a surface of flange 78 proximate core 32. Connection lug 80 is a generally rectangular, flat plate that extends perpendicularly from a lower edge of flange 78, on a side of flange 78 distal to core 32. A hole 82 is disposed in connection lug 80 and is located proximate flange 78. A semi-circular trough 84 formed in flange 78 allows a bolt, screw, rivet, or other similar fastening device to be inserted into hole 82 for securing line-side lug 66 to the contact strap 38 (FIG. 1).

Figure 3:
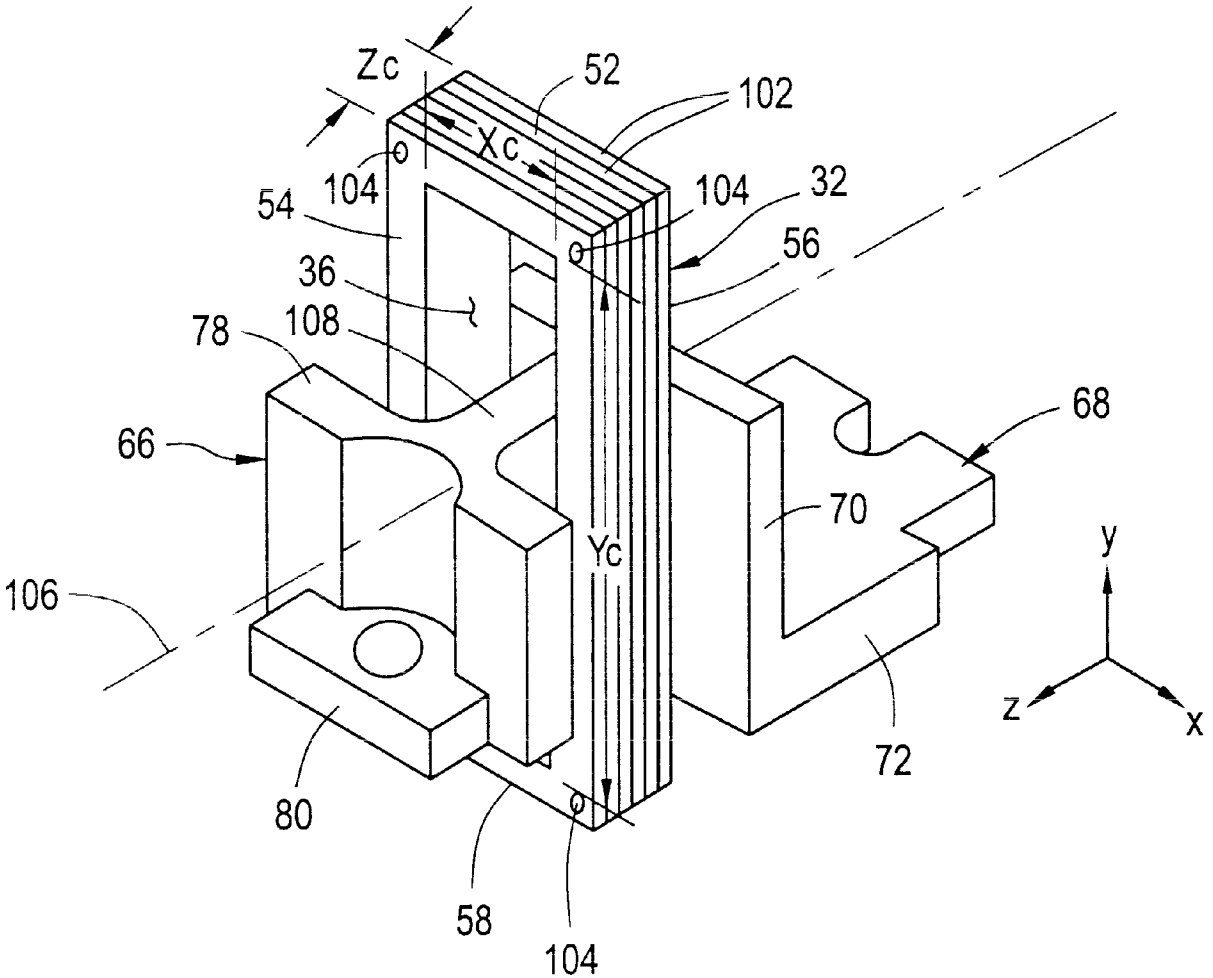
FIG. 3 is a perspective view of the core and primary conductor of the transformer of FIG. 2.

Referring to FIG. 3, a perspective view of transformer 22 is shown with secondary windings 30 removed. As can be seen in FIG. 3, core 32 comprises a plurality of plates 102 stacked to form a rectangular structure with rectangular aperture 36 symmetrically formed in the center. The plates 102 forming core 32 are constructed of ferrous metal, and are secured together by rivets 104 that extend through the corners of each plate 102. While core 32 is shown as being constructed from plates 102, it will be recognized that any known method of forming a transformer core may be used. For example, core 32 may be constructed from a solid piece of ferrous material, or may be continuously wound from a strip of ferrous material.

Aperture 36 has a height "$y_c$", a width "$x_c$", and a depth "$z_c$", which form a volume having a centroidal axis indicated at 106. In the embodiment shown, aperture 36 is rectangular. It will be recognized, however, that aperture 36 can be any shape, including round, square, triangular, etc. A conductive bar 108 extends through aperture 36, from flange 78 of line-side lug 66 to flange 70 of load-side lug 68.

Figure 4:
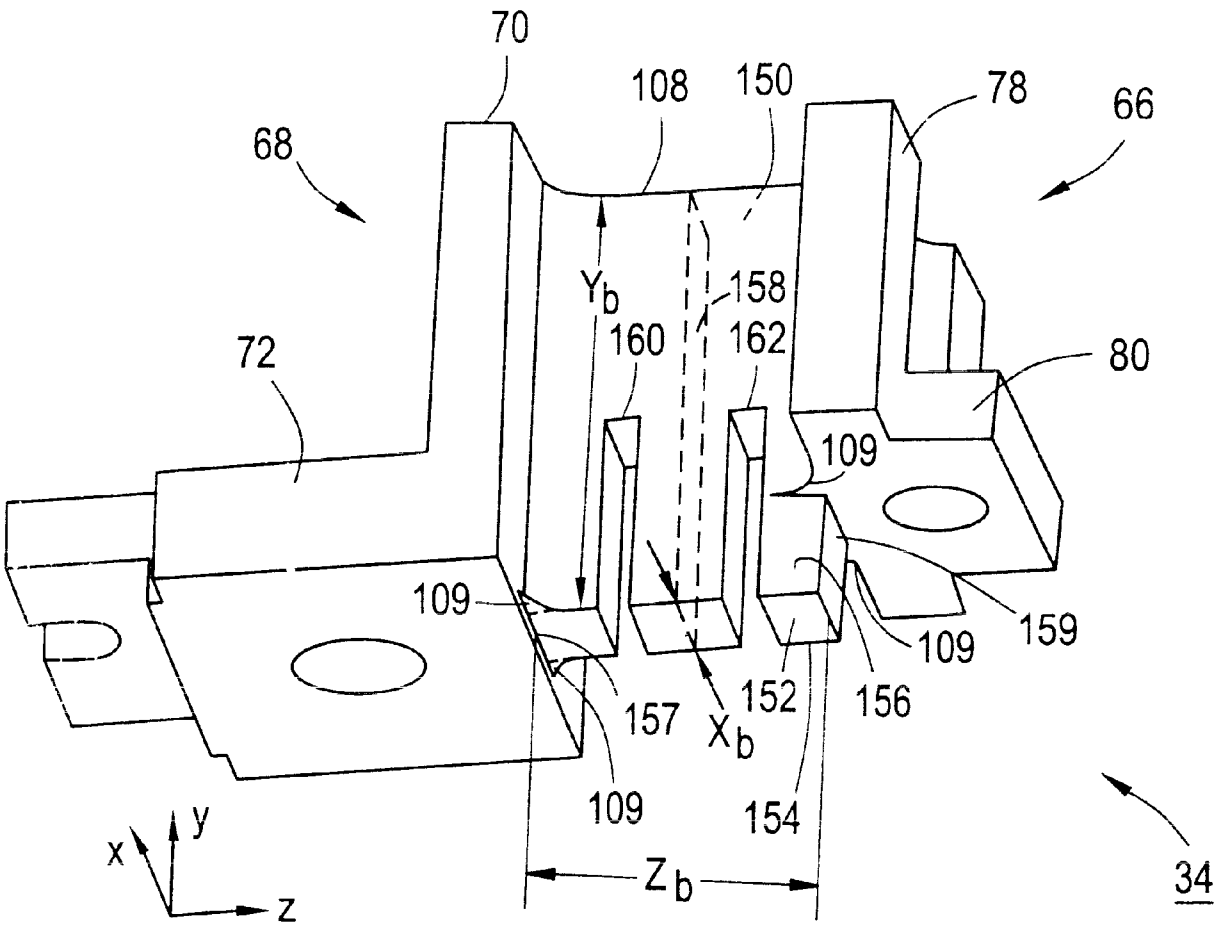
FIG. 4 is a perspective view of the primary conductor of FIG. 3.

Referring to FIG. 4, a perspective view of primary conductor 34 is shown. Conductive bar 108 has an upper surface 150, a lower surface 152, and side surfaces 154 and 156, which form a generally rectangular cross section 158. Conductive bar 108 also has a line-side end 159 attached to flange 78 and a load-side end 157 attached to flange 70. A height "$y_t$" of the conductive bar 108 extends from upper surface 150 to lower surface 152. A width "$x_b$," of the conductive bar 108 extends from side surface 154 to side surface 156, and a. length "$z_b$" of conductive bar 108 extends from lineside cad 159 to load-side end 157. As shown in FIGS. 3 and 5–7, conductive bar 108 is not centered in aperture 36. In other words, conductive bar 108 is offset from centroidal axis 106. In the embodiments shown, the centroidal axis 106 of aperture 36 is closer to upper surface 150 than a is to lower surface 152.

Referring again to FIG. 4, flange 70 extends along the entire height "$y_b$" of load-side end 157. Flange 78 extends along only a portion of the height "$y_b$" of line-side end 159, leaving a portion of load-side end 159 free from flange 78. The joints between conductive bar 108 and flanges 70 and 78 are strengthened by fillets 109, which extend from side surfaces 154 and 156 to flanges 70 and 78. Preferably, line-side lug 66, load-side lug 68, conductive bar 108, and fillets 109 are integrally cast from an electrically conductive material such as a copper or aluminum alloy. It will be recognized, however, that the portions of primary conductor 34 may be secured together using welding, bolts, rivets, or the like.

Disposed in conductive bar 108 are a pair of slots 160 and 162, which extend from lower surface 152 towards upper surface 150 for approximately one half the height "$y_b$". Slots 160 and 162 extend across the entire width "$x_b$" of conductive bar 108. Slots 160 and 162 provide a means for diverting electrical current and associated magnetic flux towards a surface of the conductive bar 108 proximate centroidal axis 106 (FIG. 3), as will be discussed in further detail hereinafter. While two slots 160 and 162 are shown, it will be recognized that additional slots may be added.

Figure 5:
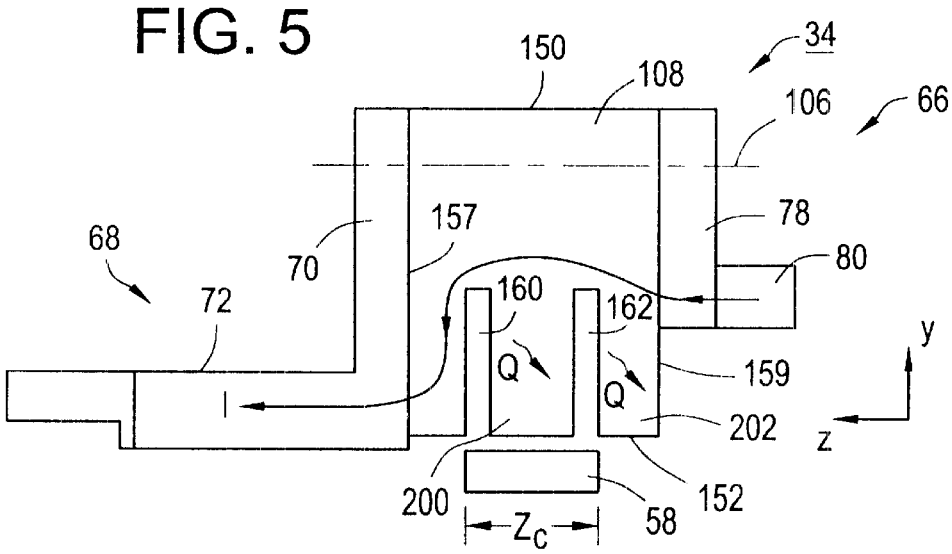
FIG. 5 is a side view of the primary conductor of FIG. 4 showing a current path through the primary conductor.

Referring to FIG. 5, a side view of primary conductor 34 is shown with a simplified current path through primary conductor 34 indicated by "I". In the embodiment shown in FIG. 5, slots 160 and 162 are positioned such that the edges of slots 160 and 162 proximate flanges 70 and 78, respectively, are spaced apart from each other a distance equal to the depth "$z_c$" of the bottom leg 58 of the core 32.

During operation, current flows from line-side lug 66, through conductive bar 108, to load-side lug 68. More specifically, current flows from connection lug 80 to flange 78, from flange 78 to line-side end 159 of conductive bar 108, from line-side end 159 of conductive bar 108 to load-side end 157 of conductive bar 108 and from flange 70 to connection lug 72.

As can be seen in FIG. 5, as the current path enters conductive bar 108, slots 160 and 162 divert the current path toward the upper surface 150 and the centroidal axis 106 and away from bottom leg 58 of the core 32. As a result of diverting the current path toward the centroidal axis 106, the magnetic flux generated by the primary conductor 34 will be concentrated near the centroidal axis 106 and away from bottom leg 58 of core 32. By moving the concentration of magnetic flux away from bottom leg 58, the primary conductor 34 reduces the susceptibility of bottom leg 58 to magnetic saturation. Because bottom leg 58 is less susceptible to magnetic saturation, the need to add ferrous material to bottom leg 58, as would be necessary in prior art transformers, is reduced or eliminated.

The current path "I" bypasses a tab 200 of conductive bar 108 formed between slots 160 and 162. In addition, the current path bypasses a tab 202 of conductive bar 108 formed between slot 162 and the portion of the load-side end 159 of conductive bar 108 that is not connected to flange 78. Tabs 200 and 202 act as cooling fins and conduct heat "Q" from the current-carrying portions of conductive bar 108 to atmosphere. Thus, in addition to diverting the current path towards the centroidal axis 106, slots 160 and 162 increase the heat dissipation capability of primary conductor 34. Indeed, the addition of slots 160 and 162 to the primary conductor has been shown to reduce the temperature rise in primary conductor 34 by approximately 9 degrees Celsius.

Figure 6:
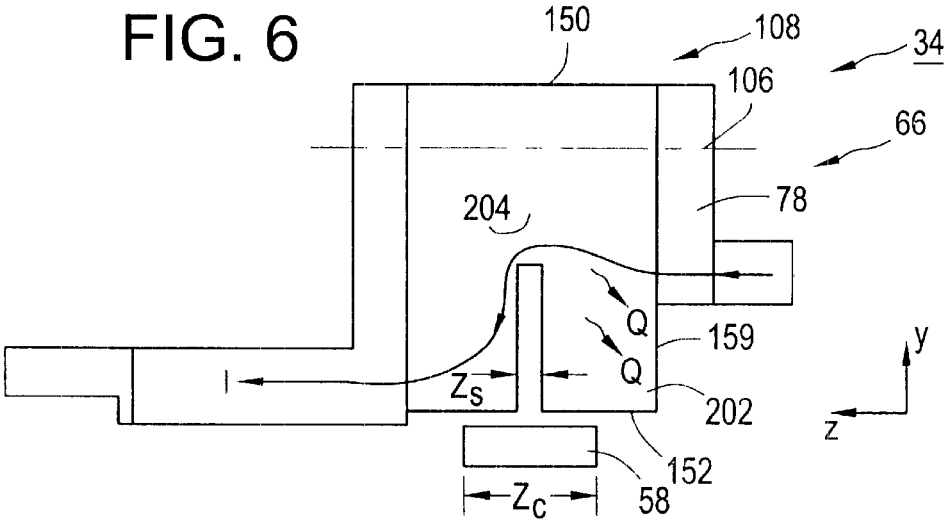
FIG. 6 is a side view of an alternative embodiment of the primary conductor of FIG. 4.

Referring to FIG. 6, a side view of an alternative embodiment of primary conductor 34 is shown. In this embodiment, primary conductor 34 includes a single slot 204 disposed therein. Slot 204 has a width "$z_s$", which is less than the depth "$z_c$" of bottom leg 58 of core 34. In this embodiment, the current path "I" bypasses a larger tab 202 formed between slot 204 and the portion of the line-side end 159 of conductive bar 108 that is not connected to flange 78. Tab 202 conducts heat "Q" from the current-carrying portions of conductive bar 108 to atmosphere.

Comparison of the current paths of FIGS. 5 and 6 shows that the current path of FIG. 6 is closer to bottom leg 58 than the current path shown in FIG. 5. This is due to the placement in FIG. 5 of slot 160, which is closer to flange 70 than slot 204 of FIG. 6. Accordingly, the embodiment of FIG. 6 would provide less divergence of magnetic flux towards centroidal axis 106 than the embodiment of FIG. 5.

Figure 7:
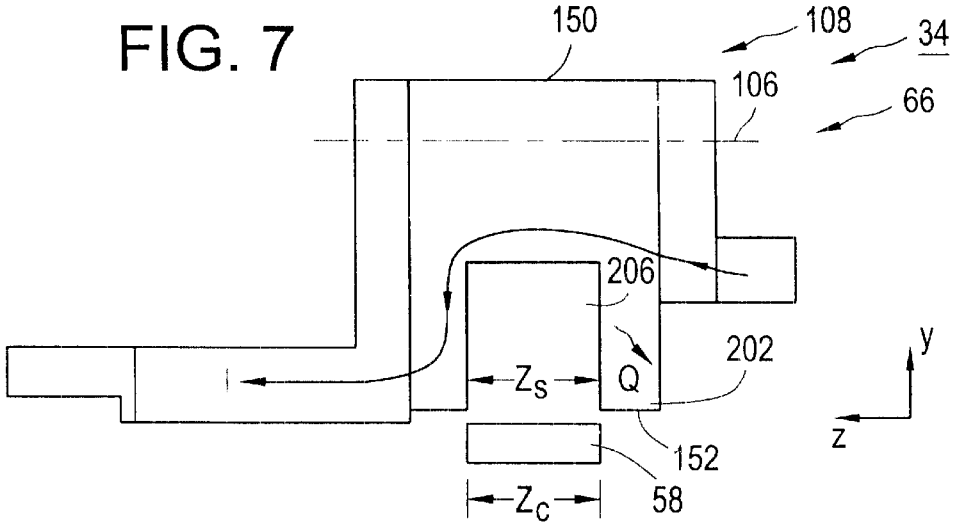
FIG. 7 is a side view of another alternative embodiment of the primary conductor of FIG. 4.

Referring to FIG. 7, a side view of another alternative embodiment of primary conductor 34 is shown. In this embodiment, primary conductor 34 includes a single slot 206 disposed therein. Slot 206 has a width "$z_s$", which is equal to or greater than the depth "$z_c$" of bottom leg 58 of core 34. In this embodiment, the current path "I" bypasses a smaller tab 202 formed between slot 204 and the portion of the line-side end 159 of conductive bar 108 that is not connected to flange 78. Tab 202 conducts heat "Q" from the current-carrying portions of conductive bar 108 to the atmosphere.

Comparison of the current paths of FIGS. 5 and 7 shows that the current path of FIG. 6 is similar to the current path shown in FIG. 5. However, the embodiment of FIG. 7 eliminates tab 200, which reduces the heat dissipation capability from that of the embodiment of FIG. 5. It will be recognized that the height of slots 160, 162, 204, or 206 can be increased or decreased to divert the current path closer to or further from, respectfully, surface 150 of the core 32.

Figure 8:
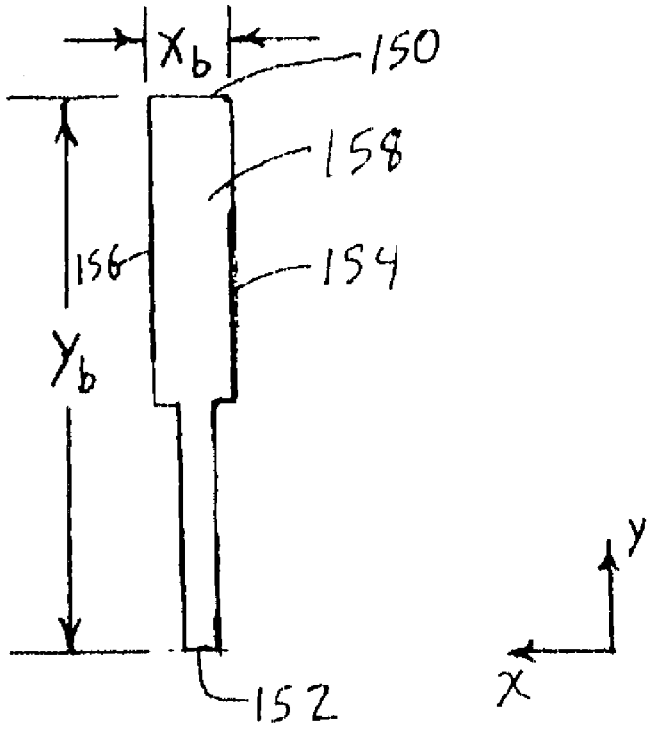
FIG. 8 is a sectional view of another alternative embodiment of the primary conductor of FIG. 4.
Figure 9:
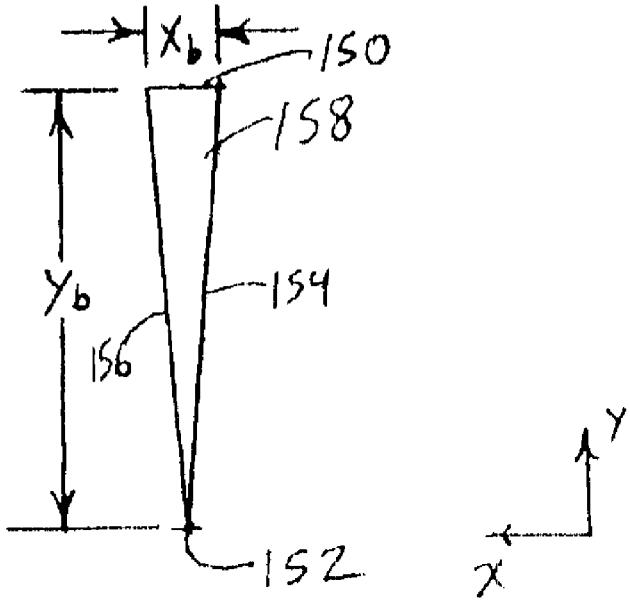
FIG. 9 is a sectional view of another alternative embodiment of the primary conductor of FIG. 4.

In addition to the use of slots 160, 162, 204, or 206, other means for diverting electrical current and associated magnetic flux towards a surface of the conductive bar 108 proximate centroidal axis 106 include varying the cross section 158 (FIG. 4) of conductive bar 108. One example is shown in FIG. 8, where cross section 158 is modified by removing conductive material from portions of sides 154 and 156 proximate lower surface 152, leaving a greater amount of conductive material near the upper surface 150. Another example is shown in FIG. 9, where cross section 158 is modified to be triangular in shape, with the base of the triangle being formed by upper surface 150, and the sides of the triangle being formed by sides 154 and 156. In the embodiments shown in FIGS. 8 and 9, the larger conductive area near upper surface 150 will allow more current to pass than will the smaller conductive area near lower surface 152. Therefore, the current flow will be more concentrated near the upper surface 150 and the centroidal axis 106 of aperture 36 (FIG. 3). It will be recognized that the means described with reference to FIGS. 8 and 9 can be implemented individually or in addition to those means described with reference to FIGS. 5–7.

By including means for diverting electrical current and magnetic flux towards centroidal axis 106, the primary conductor 34 can be offset from the centroidal axis 106 while reducing eliminating the potential for core saturation as a result of this offset. As a result, the primary conductor 34 increases the current measurement accuracy of the transformer 22 over that attainable with primary conductors of the prior art, while reducing or eliminating the need to add additional ferrous metal to the core 32. Primary conductor 34 also provides improved heat dissipation capability over primary conductors of the prior art.

Because primary conductor 34 allows transformer 22 to be designed for a greater offset of primary conductor 34, other advantages are provided as well. For example, the ability to design for a greater offset of primary conductor 34 allows the side legs 54 and 56 of core 32 to be lengthened without having to move the primary conductor 34. Lengthening of side legs 54 and 56 allows for longer and narrower secondary windings 32, which require less wire 62 for the same number of turns than a shorter, thicker secondary winding would require. The reduction in the amount of wire 32 reduces the overall cost of the transformer 22.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A transformer comprising:

a core having an aperture formed therein, said aperture having a centroidal axis; and a conductive bar extending through said core offset from said centroidal axis, a portion of said conductive bar positioned within said aperture including means for diverting electrical current flowing through said condutive bar towards said centroidal axis.

2. The transformer of claim 1, wherein said means for diverting electrical current includes a first slot disposed in said conductive bar and positioned within said aperture.

3. The transformer of claim 2, wherein said first slot has a width less than a thickness of said core as measured in a direction parallel to said centroidal axis.

4. The transformer of claim 2, wherein said means for diverting electrical current further includes a second slot disposed in said conductive bar and positioned within said aperture.

5. The transformer of claim 1, further including:

a first flange electrically coupled to a load-side end of said conductive bar;

a second flange electrically coupled to a portion of a line-side end of said conductive bar, a portion of said line-side end is free from said second flange; and wherein said means for diverting electrical current includes a first slot disposed in said conductive bar and positioned within said aperture, a first tab is formed between said first slot and said portion of said line-side end that is free from said second flange.

6. The transformer of claim 5, wherein said means for diverting electrical current further includes a second slot disposed in said conductive bar and positioned within said aperture, a second tab is formed between said second slot and said first slot.

7. The transformer of claim 1, wherein said means for diverting electrical current includes a reduction in cross sectional area of said portion of said conductive bar positioned within said aperture.

8. The transformer of claim 7, wherein said portion of said conductive bar positioned within said aperture has a triangular cross section.

9. A transformer comprising:

a core having an aperture formed therein, said aperture having a centroidal axis; and a conductive bar extending through said core offset from said centroidal axis, said conductive bar including a first slot disposed in said conductive bar and positioned within said aperture, and a second slot disposed in said conductive bar and positioned within said aperture, wherein a first tab is formed between said first and second slots.

10. The transformer of claim 9, further comprising:

a first flange electrically coupled to a load-side end of said conductive bar;

a second flange electrically coupled to a portion of a line-side end of said conductive bar, a portion of said line-side end is free from said second flange; and wherein a second tab is formed between said first slot and said portion of said line-side end that is free from said second flange.

11. A transformer comprising:

a core having an aperture formed therein, said aperture having a centroidal axis; and a conductive bar extending through said core offset from said centroidal axis, said conductive bar including a region of reduced cross sectional area located within said aperture.

12. The transformer of claim 11, wherein said region of reduced cross sectional area located within said aperture has a triangular cross section.

* * * * *